US009759410B2

(12) United States Patent
Hirano et al.

(10) Patent No.: US 9,759,410 B2
(45) Date of Patent: Sep. 12, 2017

(54) HOLDER HAVING CLAW TO HOLD LIGHT-EMITTING MODULE, LIGHTING APPARATUS INCLUDING THE HOLDER, AND LIGHTING APPARATUS MANUFACTURING METHOD USING THE HOLDER

(71) Applicant: PANASONIC INTELLECTUAL PROPERTY MANAGEMENT CO., LTD., Osaka (JP)

(72) Inventors: Akihiro Hirano, Shiga (JP); Tetsuya Kumagai, Gumma (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 49 days.

(21) Appl. No.: 14/829,706

(22) Filed: Aug. 19, 2015

(65) Prior Publication Data

US 2016/0076745 A1 Mar. 17, 2016

(30) Foreign Application Priority Data

Sep. 12, 2014 (JP) ..... 2014-185991

(51) Int. Cl.
*F21V 19/00* (2006.01)
*F21Y 115/10* (2016.01)

(52) U.S. Cl.
CPC ..... *F21V 19/0015* (2013.01); *F21V 19/004* (2013.01); *F21Y 2115/10* (2016.08)

(58) Field of Classification Search
CPC .... F21V 19/003; F21V 19/004; F21V 17/164; F21V 19/0015; F21Y 2115/10
See application file for complete search history.

(56) References Cited

U.S. PATENT DOCUMENTS 7,872,278 B2 * 1/2011 Stoyan ..... F21K 9/00 257/100
8,672,518 B2 * 3/2014 Boomgaarden ..... F21S 8/026 362/147
8,834,194 B2 * 9/2014 Sakai ..... F21V 29/22 439/345

(Continued)

FOREIGN PATENT DOCUMENTS

JP 2008-153080 7/2008
JP 2014-103088 6/2014
NL WO 2015028902 A1 * 3/2015 ..... F21V 19/004

*Primary Examiner* — Robert May
(74) *Attorney, Agent, or Firm* — Greenblum & Bernstein, P.L.C.

(57) ABSTRACT

A holder to be placed on a base portion together with a light-emitting module having a board-like shape includes: a body portion; and a claw portion that is provided in the body portion, and locks onto at least a portion of a base portion-side face of the light-emitting module to temporarily hold the light-emitting module when the light-emitting module is to be placed on the base portion. In a state prior to when the holder is placed on the base portion, at least a portion of the claw portion is located closer to the base portion than a base portion-side face of the holder is. The claw portion has a shape that releases the temporary holding of the light-emitting module as a result of the claw portion abutting the base portion when the holder is placed on the base portion in a state where the light-emitting module is temporarily held.

14 Claims, 17 Drawing Sheets

(56) References Cited

U.S. PATENT DOCUMENTS

| | | | | |
|---|---|---|---|---|
| 2008/0144320 | A1 | 6/2008 | Tokunaga | |
| 2014/0119057 | A1 | 5/2014 | Toshikawa | |
| 2016/0195249 | A1* | 7/2016 | Liao | F21V 19/004 362/368 |

* cited by examiner

HOLDER HAVING CLAW TO HOLD LIGHT-EMITTING MODULE, LIGHTING APPARATUS INCLUDING THE HOLDER, AND LIGHTING APPARATUS MANUFACTURING METHOD USING THE HOLDER

CROSS REFERENCE TO RELATED APPLICATION

This application claims the benefit of priority of Japanese Patent Application Number 2014-185991, filed Sep. 12, 2014, the entire content of which is hereby incorporated by reference.

BACKGROUND OF THE INVENTION

1. Field of the Invention

The present disclosure relates to a holder for a light-emitting module, a lighting apparatus including the holder, and a method of manufacturing the lighting apparatus.

2. Description of the Related Art

From an energy-saving viewpoint, recent years have seen a rapid rise in the popularity of light-emitting diode (LED) lights. An LED light includes, for example, a base portion (for example, the apparatus body) such as a heat sink, and an LED module that is placed on the base portion. The LED module includes, for example, a board, and plural LEDs mounted on the board.

Known methods of placing an LED module on a base portion include methods which use a holder. For example, there is known a method of placing an LED module on a base portion by holding the LED module using a holder and placing and fixing the holder on the base portion in such a state (see, for example, Japanese Unexamined Patent Application Publication No. 2008-153080 (Patent Literature 1)).

SUMMARY OF THE INVENTION

Since heat is generated when the LED module emits light, the heat dissipation of the LED module should be taken into consideration when attaching the LED module to the base portion, and thus the LED module and the base portion need to be connected.

However, with a conventional holder, it is difficult to ensure sufficient heat dissipation for the LED module while maintaining assemblability (attachability) between the holder and the LED module and base portion.

The present disclosure is conceived to solve the aforementioned problem and has as an object to provide a holder, a lighting apparatus, and so on, that are capable of ensuring sufficient heat dissipation for the light-emitting module while maintaining assemblability (attachability) between the holder and the LED module and base portion.

A holder according to an aspect of the present disclosure is a holder to be placed on a base portion together with a light-emitting module having a board-like shape, and includes: a body portion; and a claw portion that is provided in the body portion, and locks onto at least a portion of a base portion-side face of the light-emitting module to temporarily hold the light-emitting module when the light-emitting module is to be placed on the base portion, wherein, in a state prior to when the holder is placed on the base portion, at least a portion of the claw portion is located closer to the base portion than a base portion-side face of the holder is, and the claw portion has a shape that releases the temporary holding of the light-emitting module as a result of the claw portion abutting the base portion when the holder is placed on the base portion in a state where the light-emitting module is temporarily held.

The holder and the lighting apparatus according to the present disclosure are capable of ensuring sufficient heat-dissipation for the light-emitting module while maintaining assemblability between the holder and the light-emitting module and base portion.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE PREFERRED EMBODIMENT

Exemplary embodiments of the present disclosure will be described below. It should be noted that each of the subsequently-described exemplary embodiments show a specific preferred example of the present disclosure. The numerical values, shapes, materials, structural components, the arrangement and connection of the structural components, as well as procedural steps and the sequence of the steps, etc. shown in the following exemplary embodiments are mere examples, and are not intended to limit the scope of the present disclosure. Therefore, among the structural components in the following exemplary embodiments, components not recited in any one of the independent claims which indicate the broadest concepts of the present disclosure are described as arbitrary structural components.

Furthermore, the respective figures are schematic diagrams and are not necessarily precise illustrations. Furthermore, in the respective figures, substantially identical components are assigned the same reference signs, and overlapping description is omitted or simplified.

Embodiment 1

[Lighting Apparatus]

Figure 1:
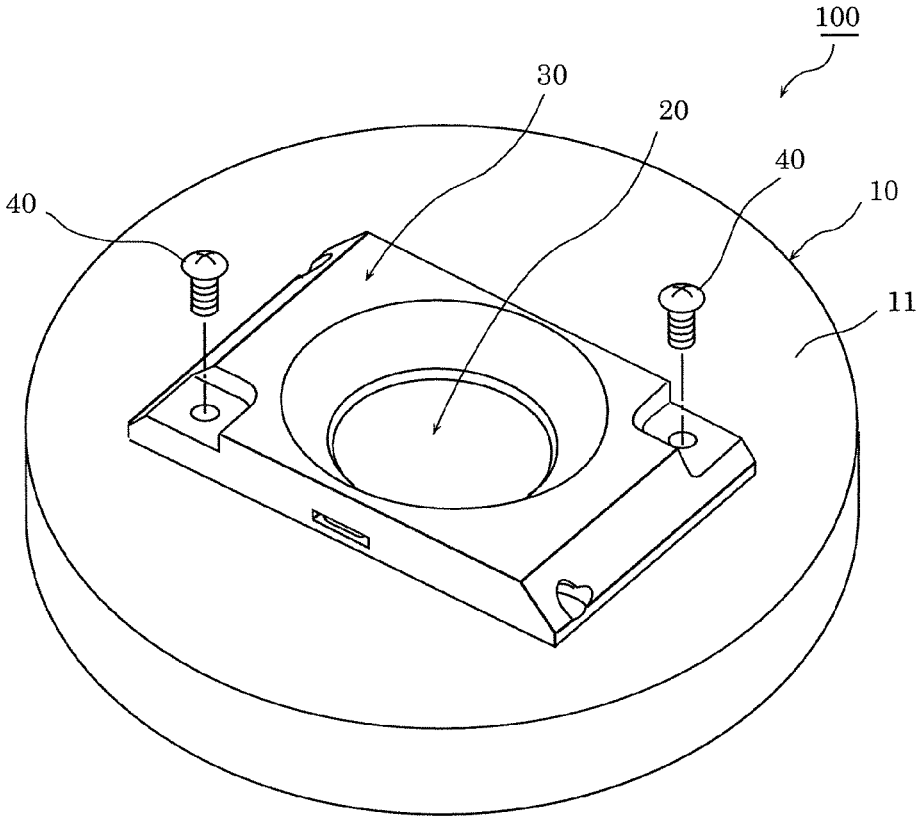
FIG. 1 is a perspective view of a basic structure of a lighting apparatus according to Embodiment 1
Figure 2:
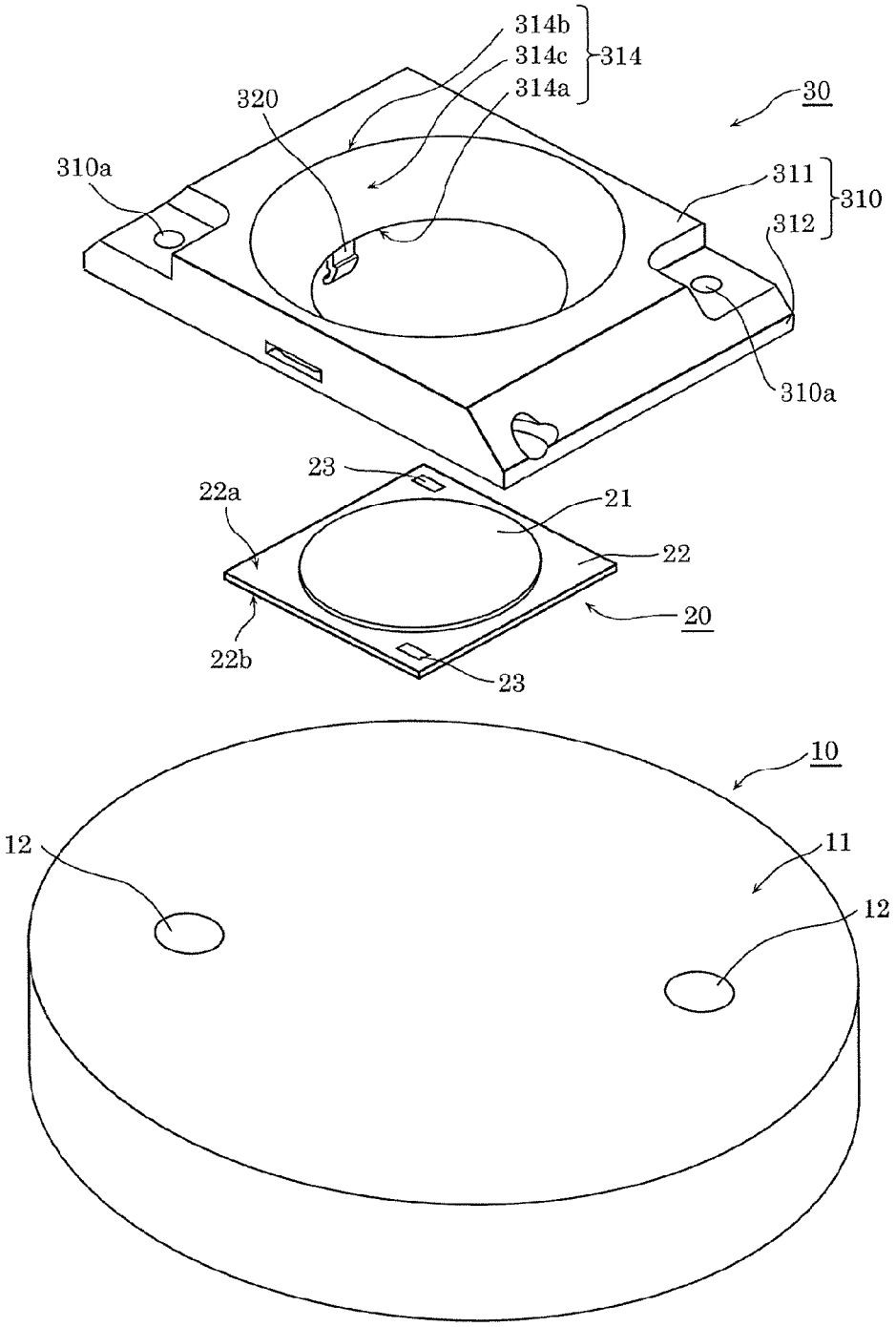
FIG. 2 is an exploded perspective view of the structure illustrated in FIG. 1.

First, lighting apparatus 100 according to Embodiment 1 of the present disclosure will be described using FIG. 1 and FIG. 2. FIG. 1 is a perspective view of a basic structure of a lighting apparatus according to Embodiment 1. FIG. 2 is an exploded perspective view of the structure illustrated in FIG. 1.

As illustrated in FIG. 1, lighting apparatus 100 according to this embodiment includes base portion 10, light-emitting module 20 which is placed on placement face (attachment face) 11 of base portion 10, and holder 30 for placing light-emitting module 20 on base portion 10.

Lighting apparatus 100 is, for example, a downlight that is recessed in the ceiling with light-emitting module 20 facing downward (i.e., facing the floor).

Aside from being for the placement of light-emitting module 20, base portion 10 also functions as a heat sink that dissipates the heat of light-emitting module 20. Therefore, base portion 10 should be made of a highly heat-conductive material such as metal. Base portion 10 is, for example, a metal base made of aluminum.

Placement face 11 of base portion 10 and light-emitting module 20 should be in surface-to-surface contact. Placing light-emitting module 20 on placement face 11 of base portion 10 with surface-to-surface contact therebetween allows the heat generated by light-emitting module 20 to be dissipated efficiently.

Furthermore, as illustrated in FIG. 2, screw holes 12 for screwing holder 30 to base portion 10 are provided in placement face 11 of base portion 10. In this embodiment, two screw holes 12 are provided in base portion 10.

It should be noted that base portion 10 may be the apparatus body of the lighting apparatus or may be provided separately from the apparatus body. Furthermore, although base portion 10 is shaped like a columnar pedestal in this embodiment, base portion 10 is not limited to such a shape and may be a rectangular parallelepiped, etc.

As illustrated in FIG. 2, light-emitting module 20 includes light-emitting component 21 and board 22 on which light-emitting component 21 is provided. Board 22 is a flat mounting board having front face 22*a* and back face 22*b*. Front face 22*a* of board 22 is the face on which light-emitting component 21 is provided. Back face 22*b* of board 22 is the face that is placed on placement face 11 of base portion 10. In this disclosure, light-emitting module 20 is a thin board-like light-emitting module.

Although board 22 may be configured of a highly heat conductive material and is, for example, a ceramic board made of ceramic such as alumina, or a metal-based board made of a metal board that is insulation-coated, etc., board 22 is not limited to such. Furthermore, although the shape of board 22 is, for example, rectangular in the plan view, the plan view shape is not limited to such and may be circular, polygonal, etc.

Light-emitting module 20 according to this embodiment is an LED module having a chip on board (COB) structure in which an LED chip is directly mounted on board 22. In this case, light-emitting component 21 includes one or more LED chips mounted on board 22 and a sealing component that seals the one or more LED chips. For example, plural LED chips are arranged in a matrix and the sealing component collectively seals the plural LED chips. In this embodiment, the shape of the sealing component is circular in the plan view. In this case, the plan view shape of light-emitting component 21 is also circular. It should be noted that the sealing component may collectively seal all the LED chips as in the present embodiment, or may seal the respective LED chips individually in the form of dots, or may seal plural LED chips that are arranged in lines, on a line basis, to form plural straight lines.

Light-emitting module 20 emits white light, for example. In this case, a blue LED chip that emits blue light when current is supplied can be used as an LED chip, and a silicone resin containing a yellow phosphor (i.e., a phosphor-containing resin) can be used as the sealing component.

It should be noted that the color of light emitted by light-emitting module 20 is not limited to white light, and may be a colored light. Furthermore, light-emitting module 20 may be a color-adjustable light-emitting module.

As described above, light-emitting module 20 should be in surface-to-surface contact with placement face 11 of base portion 10. In particular, there should be surface-to-surface contact between back face 22*b* of board 22 of light-emitting module 20 and placement face 11 of base portion 10. In this embodiment, the entire surface of back face 22*b* is in surface-to-surface contact with placement face 11 of base portion 10.

It should be noted that a pair of metal electrodes (power supplying terminals) 23 are provided in front face 22*a* of board 22. The pair of metal electrodes 23 are electrically connected to light-emitting elements (LED chips) of light-emitting component 21 via a wiring pattern (not illustrated) formed on front face 22*a* of board 22. Light-emitting component 21 emits light when predetermined power is supplied from the pair of metal electrodes 23.

Light-emitting module 20 is placed on base portion 10 using holder 30, and fixing holder 30 to base portion 10 causes light-emitting module 20 to be fixed to base portion 10. Holder 30 is, for example, screwed to base portion 10 using screws 40, as illustrated in FIG. 1. In this manner, light-emitting module 20 is fixed to base portion 10 together with holder 30.

It should be noted that, aside from the components illustrated in FIG. 1 and FIG. 2, lighting apparatus 100 may include other components such as a light-transmissive cover placed to cover light-emitting module 20, or a power supply circuit, etc. Furthermore, although a single light-emitting module 20 is placed on base portion 10 in the present embodiment, plural light-emitting modules 20 may be placed on base portion 10.

[Holder]

Figure 3:
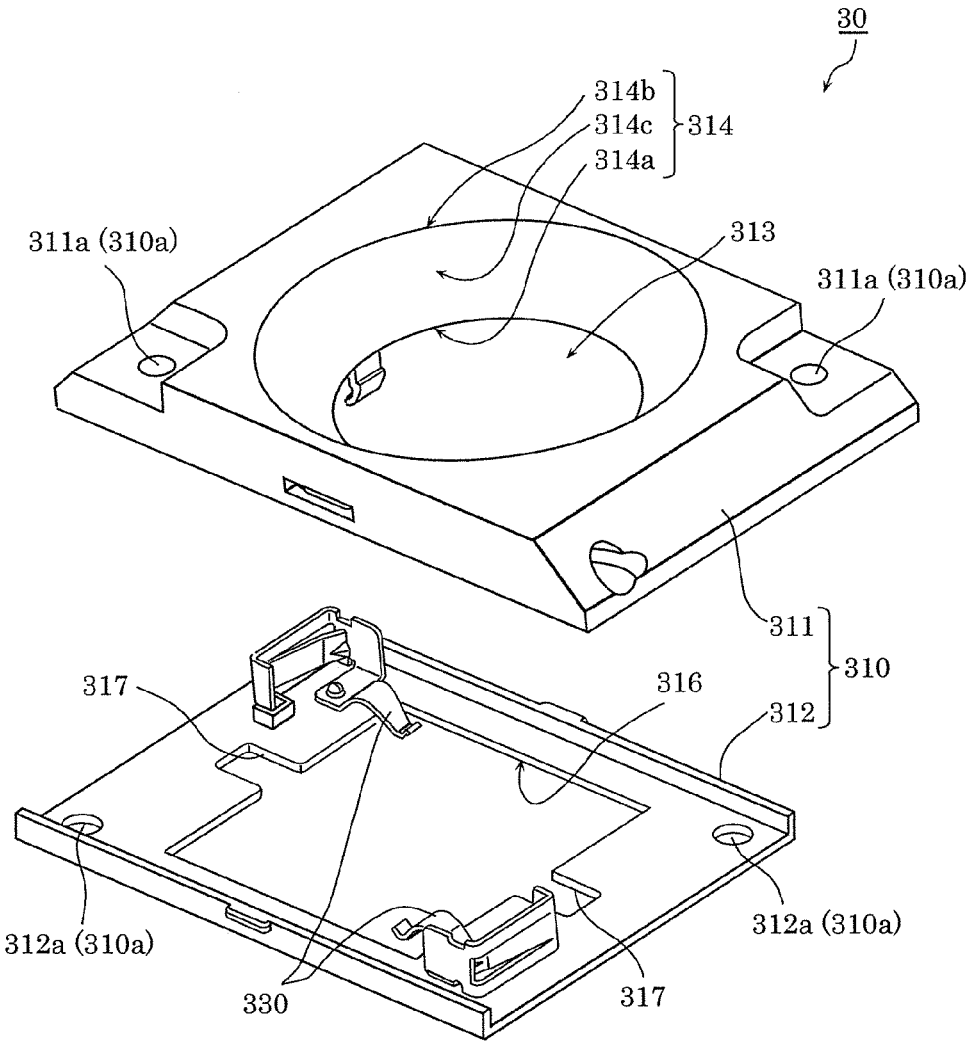
FIG. 3 is a perspective view of a holder according to Embodiment 1 as seen from above.
Figure 4:
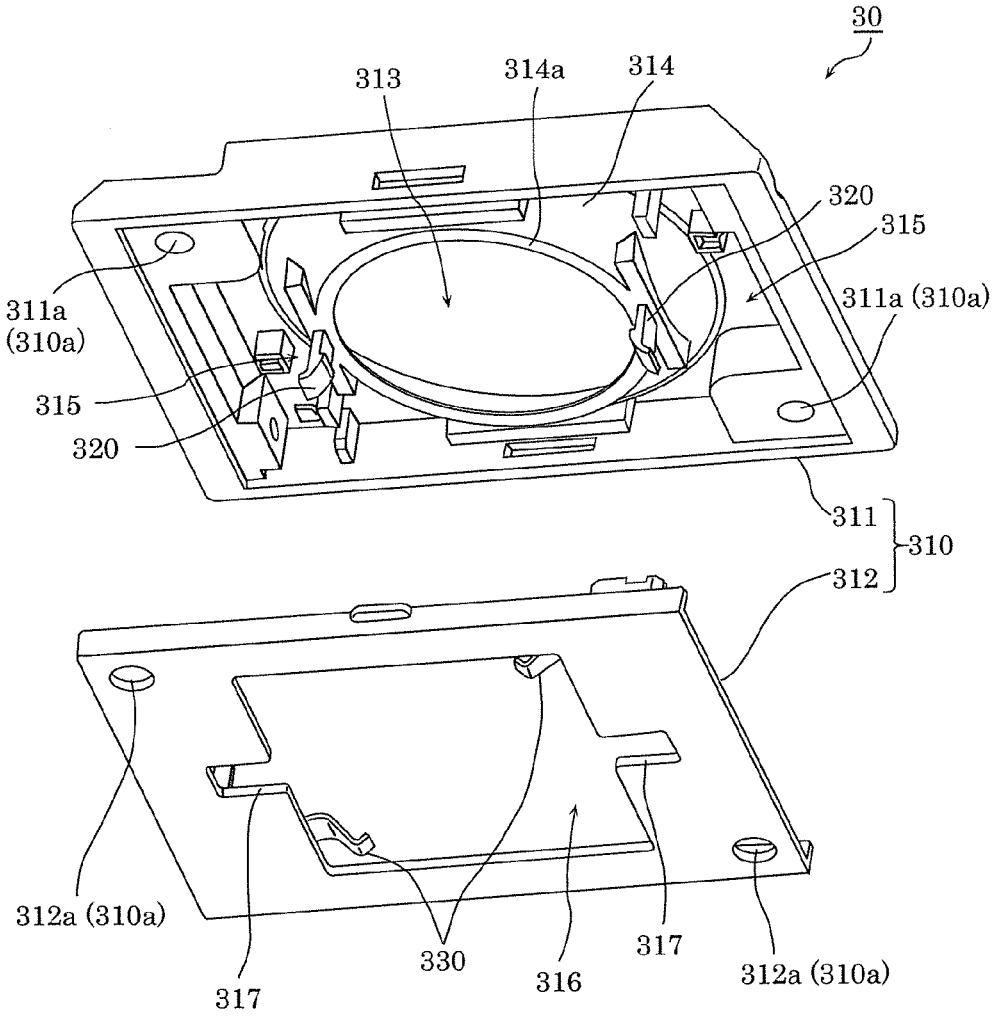
FIG. 4 is a perspective view of the holder according to Embodiment 1 as seen from below.

Next, a configuration of holder 30 according to this embodiment will be described using FIG. 3 and FIG. 4. FIG. 3 and FIG. 4 are exploded perspective views of the holder according to Embodiment 1; FIG. 3 is a view from above and FIG. 4 is a view from below.

As illustrated in FIG. 3 and FIG. 4, holder 30 includes body portion 310, claw portions 320 provided in body portion 310, and a pair of contact terminals 330 provided in body portion 310. Holder 30 is to be placed on base portion 10 together with light-emitting module 20 which has a board-like shape.

Body portion 310 is a case, and includes housing 311 and cover 312 which covers the opening on the backside (base portion 10 side) of housing 311. Cover 312 is fitted to housing 311 to cover the opening on the back side of housing 311. For example, housing 311 and cover 312 can be fixed together by fitting projections provided in lateral faces of cover 312 into openings provided in lateral faces of housing 311. Housing 311 and cover 312 are, for example, resin molded components made using a resin material.

Through holes 310*a* for passing screws 40 (see FIG. 1) when holder 30 and base portion 10 are screwed together is provided in body portion 310. Specifically, two through holes 311*a* are provided in housing 311 and two through holes 312*a* are also provided in cover 312. Corresponding ones of through holes 311*a* and through holes 312*a* communicate with each other.

Housing 311 includes opening portion 313 which is provided as an opening for light-emitting component 21 of light-emitting module 20. The light emitted from light-emitting component 20 is discharged via opening portion 313.

Furthermore, housing 311 includes cylindrical portion 314 which is configured to surround opening portion 313. Cylindrical portion 314 is formed in the shape of a ring to surround light-emitting component 21 of light-emitting module 20. In this embodiment, cylindrical portion 314 is provided projecting toward cover 312 from the inner face of the upper portion of housing 311.

Specifically, cylindrical portion 314 includes first opening end 314*a* a which is the opening end portion on the light-emitting module 20 side, second opening end 314*b* which is the opening end portion on the side opposite that of first opening end 314*a*, and inner wall face 314*c* between first opening end 314*a* and second opening end 314*b*.

First opening end 314*a* is an entrance aperture into which the light from light-emitting module 20 enters. Second opening end 314*b* is an exit aperture from which the light of light-emitting module 20 exits opening portion 313. Inner wall face 314*c* is a reflecting face that reflects the light that has entered from first opening end 314*a*.

Furthermore, cylindrical portion 314 is configured in such a way that the area of the opening increases from first opening end 314*a* toward second opening end 314*b*. Specifically, cylindrical portion 314 is a circular truncated cone-shaped cylinder in which the internal diameter of inner wall face 314*c* increases from first opening end 314*a* toward second opening end 314*b*.

Claw portions 320 are provided in housing 311. In this embodiment, claw portions 320 are integrally formed with housing 311, and are made from a resin material, for example.

As illustrated in FIG. 4, each of claw portions 320 is formed to project from a portion of first opening end 314*a* of cylindrical portion 314 of housing 311 toward cover 312 (base portion 10). In this embodiment, a pair of claw portions 320 is provided, with each of claw portions 320 facing the other across opening portion 313 of body portion 310.

Specifically, the pair of claw portions 320 sandwich light-emitting module 20 from the outside in plan view when holder 30 temporarily holds light-emitting module 20. For example, the pair of claw portions 320 are provided corresponding to the center portions of two opposing sides of board 22 of light-emitting module 20. It should be noted that the number of claw portions 320 is not limited to two, and may be one as long as holding board 22 can be held, or three or more to enable more stable holding.

Furthermore, in the state prior to when holder 30 is placed on base portion 10, at least a portion of each claw portion 320 is located closer to base portion 10 than the base portion 10-side face of holder 30 (i.e., the outer face of cover 312) is.

Claw portions 320 have a structure that locks onto at least a portion of the base portion 10-side face of light-emitting module 20 to temporarily hold light-emitting module 20 when light-emitting module 20 is to be placed on base portion 10. In this embodiment, claw portions 320 lock onto at least a portion of back face 22*b* of board 22 of light-emitting module 20 to temporarily hold (temporarily fix) light-emitting module 20. In other words, claw portions 320 need only be of a structure that supports back face 22*b* of board 22, and need not be in contact with end faces (lateral faces) of board 22. It should be noted that in the present disclosure, "lock onto" means becoming hooked and fixed to something.

Figure 5A:
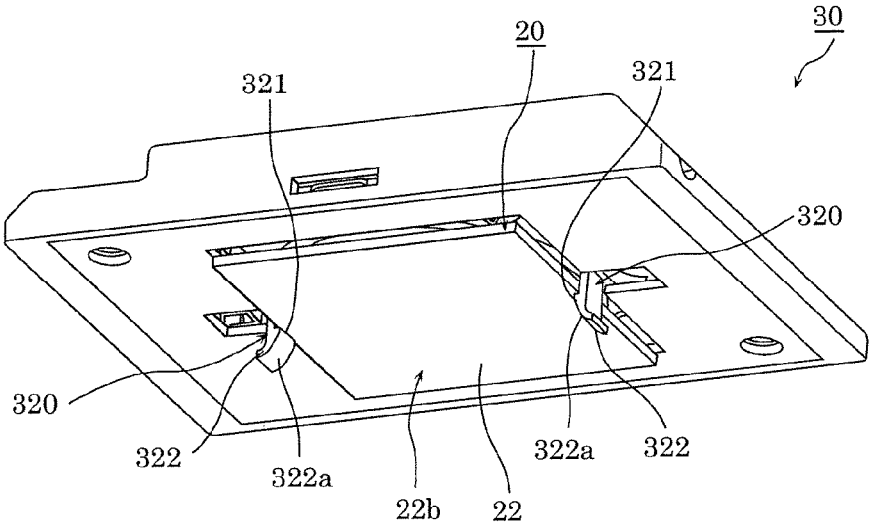
FIG. 5A is a perspective view of a light-emitting module temporarily held by the holder according to Embodiment 1 as seen from below.
Figure 5B:
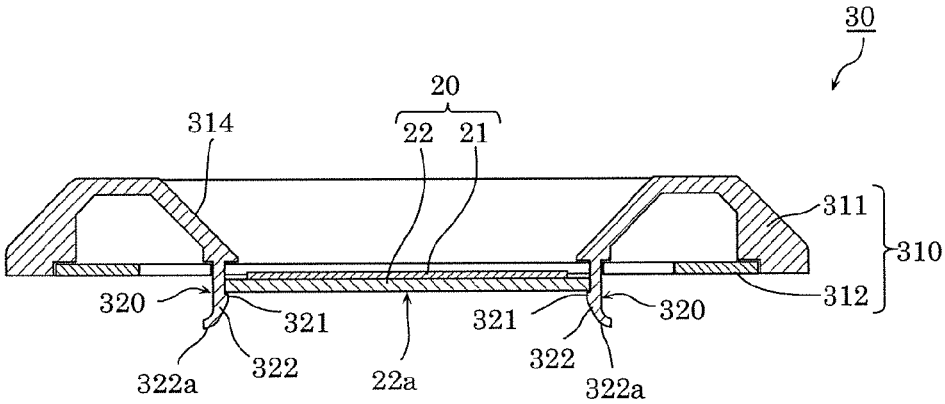
FIG. 5B is a cross-sectional view of the holder according to Embodiment 1 and the light-emitting module temporarily held by the holder.

Here, light-emitting module 20 that is temporarily held by holder 30 will be described using FIG. 5A and FIG. 5B. FIG. 5A and FIG. 5B are diagrams illustrating the state in which the light-emitting module is temporarily held by the holder according to Embodiment 1; FIG. 5A is a perspective view from below, and FIG. 5B is a cross-sectional view of the holder and the light-emitting module.

As illustrated in FIG. 5A and FIG. 5B, each of the pair of claw portions 320 extends further downward (i.e., toward base portion 10) than back face 22*b* of board 22 of light-emitting module 20, and has hook portion (latch portion) 321 that hooks onto back face 22*b* of board 22 of light-emitting module 20. Specifically, hook portion 321 has, for example, a cross-section shaped like a letter L extending from the lateral face of an end of board 22 of light-emitting module 20 up to back face 22*b* to allow hook portion 321 to latch onto light-emitting module 20 by snapping-in. Light-emitting module 20 can be hooked using the pair of claw portions 320 configured in the above-described manner. Accordingly, light-emitting module 20 can be temporarily held by the pair of claw portions 320.

Furthermore, claw portions 320 are shaped in such a way that, when holder 30 is placed on base portion 10 in the state where light-emitting module 20 is temporarily held, the temporary holding of light-emitting module 20 is released when claw portions 320 abut base portion 10.

Specifically, claw portions 320 are shaped in such away that, when claw portions 320 abut base portion 10, the pressing force received from base portion 10 causes claw portions 320 to deform in a way that releases (disengages) light-emitting module 20. In other words, claw portions 320 are shaped to deform away from claw light-emitting module 20.

In this embodiment, claw portions 320 are integrally formed with housing 311 using a resin material, and are plastically-deformed by the pressing force received from base portion 10.

Furthermore, each of claw portions 320 includes abutting portion 322. As illustrated in FIG. 5B, abutting portions 322 are the tips of claw portions 320, and are the parts that abut placement face 11 when holder 30 is placed on placement face 11 of base portion 10. In this embodiment, abutting portions 322 have an outwardly-extending shape.

Abutting faces 322*a* of abutting portions 322, which have outwardly-extending shapes, are, for example, sloped faces or curved faces. Accordingly, since abutting portions 322 follow placement face 11 of base portion 10, claw portions 320 can be easily be deformed to spread outward.

Furthermore, the space between (the opposing faces of) abutting portions 322 of the pair of claw portions 320 increases toward base portion 10. This allows each of the pair of claw portions 320 to be easily deformed to spread outward.

Returning to FIG. 3 and FIG. 4, a pair of contact terminals 330 are fixed to cover 312. The pair of contact terminals 330 are electrically connected to light-emitting module 20. Specifically, the pair of contact terminals 330 come into contact with the pair of metal electrodes 23 of light-emitting module 20 when light-emitting module 20 is fixed to base portion 10 using holder 30.

The pair of contact terminals 330 have, for example, a leaf spring structure consisting of metal boards, etc., and are fixed to cover 312. In this embodiment, light-emitting module 20 is fixed to base portion 10 by pressing light-emitting module 20 against base portion 10 using holder 30. At this time, the pair of metal electrodes 23 of light-emitting module 20 are pressed down by the elastic force of the springs of the pair of contact terminals 330. In this manner, contact terminals 330 and metal electrodes 23 are kept in contact by pushing against each other under the elastic force of the springs of contact terminals 330.

It should be noted that each of the pair of contact terminals 330 is electrically and physically connected to an external lead wire (not illustrated) that is inserted through an insertion hole provided in body portion 310. For example, power can be supplied to the pair of contact terminals 330 by inserting the external lead wires, which are connected to a power supply circuit, into the insertion holes after holder 30 and light-emitting module 20 are fixed to base portion 10.

Furthermore, as illustrated in FIG. 3 and FIG. 4, storage portions 315 for storing the deformed claw portions 320 are provided in body portion 310. Storage portions 315 are internal regions of body portion 310, and are specifically spatial regions between housing 311 and cover 312. In other words, body portion 310 includes, as storage portions 315, spaces for storing claw portions 320 when claw portions 320 have deformed and collapsed.

Furthermore, as illustrated in FIG. 3 and FIG. 4, opening portion 316 is formed in cover 312. Opening portion 316 is opened to correspond to light-emitting module 20. In the plan view, the shape of opening portion 316 is the same as the shape of light-emitting module 20, and the size of opening portion 316 is greater than or equal to the size of light-emitting module 20. In this embodiment, opening portion 316 is a rectangular opening.

In addition, as illustrated in FIG. 3 and FIG. 4, cut-out portions 317 are formed in cover 312. Cut-out portions 317 are formed by making cut outs at portions of opening portion 316 at positions corresponding to claw portions 320. Accordingly, as illustrated in FIG. 5A and FIG. 5B, when housing 311 and cover 312 are put together, claw portions 320 project from cover 312 via cut-out portions 317.

Furthermore, the cut-out length (depth direction length) of cut-out portions 317 is greater than the projection length of claw portions 320. Accordingly, when claw portions 320 abut base portion 10 and deform, claw portions 320 can deform passing through cut-out portions 317.

[Light-emitting Module Placement Method]

Figure 6:
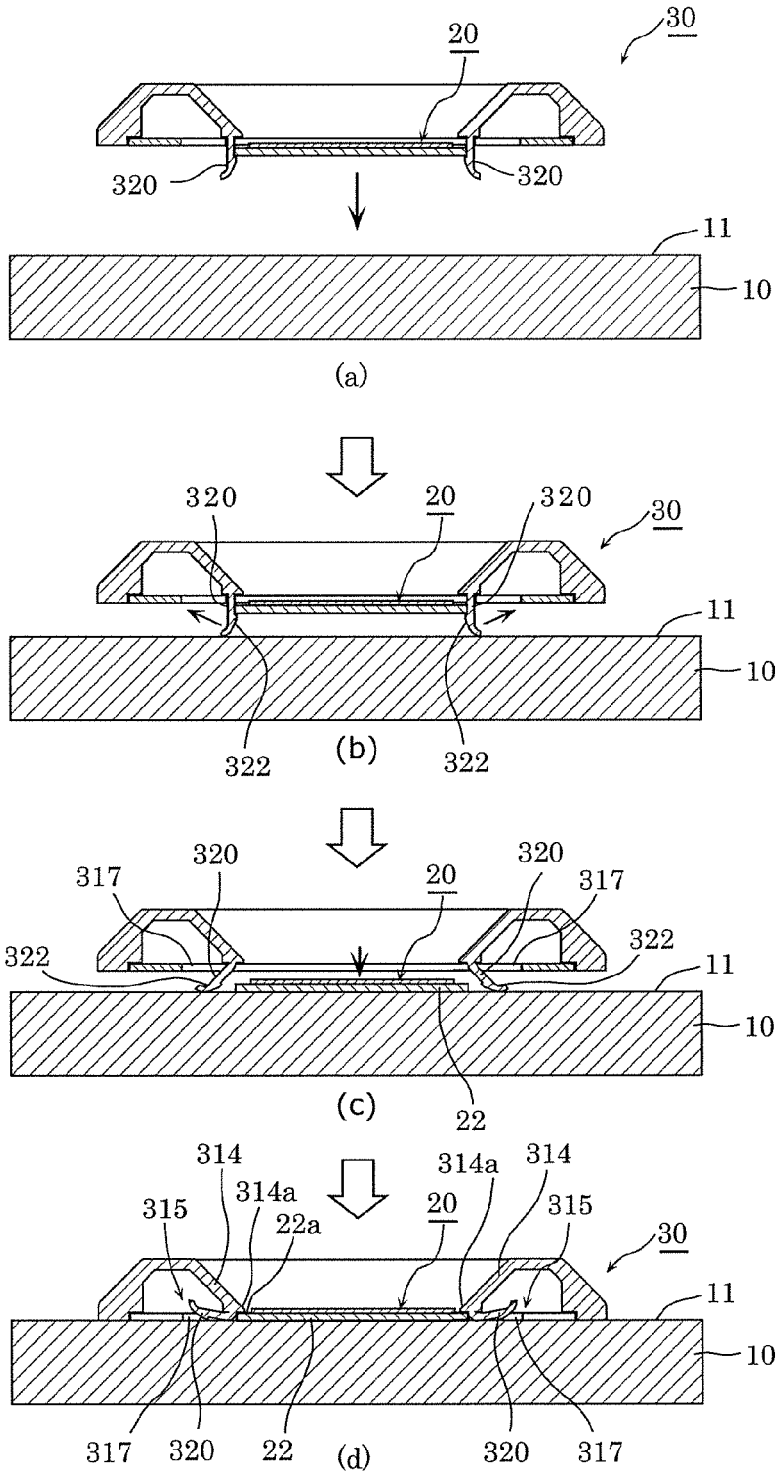
FIG. 6 is a diagram for describing a method used when placing the light-emitting module on a base portion using the holder according to Embodiment 1.

Next, the method used when placing light-emitting module 20 on base portion 10 using holder 30 will be described using FIG. 6. FIG. 6 is a diagram for describing the method used when placing the light-emitting module on the base portion using the holder according to Embodiment 1.

As illustrated in (a) in FIG. 6, hooking light-emitting module 20 onto hook portions 321 of the pair of claw portions 320 of holder 30 allows light-emitting module 20 to be temporarily held by (temporarily fixed to) holder 30, and thus allows holder 30 and light-emitting module 20 to be integrated. Then, in such a state, holder 30 is lowered onto placement face 11 of base portion 10.

At this time, as illustrated in (b) in FIG. 6, claw portions 320 are located closer to base portion 10 than the base portion 10-side face (the back face of the body portion) of holder 30 is, and thus abutting portions 322 of claw portions 320 abut against placement face 11 of base portion 10.

In this manner, by further pressing holder 30 toward base portion 10 (i.e., in the attachment direction) when claw portions 320 are abutting base portion 10, the pressing force received from base portion 10 causes each of the pair of claw portions 320 to deform by spreading outward to release light-emitting module 20. In other words, each of the pair of claw portions 320 deforms to move away from the other, and thus move away from light-emitting module 20.

In this embodiment, abutting portions 322 of claw portions 320 have outwardly-extending shapes, and thus claw portions 320 can be easily deformed to spread outward by pressing holder 30 against base portion 10 to press abutting portions 322 against placement face 11 of base portion 10.

Then, by pressing holder 30 further toward base portion 10 to cause claw portions 320 to further deform and spread outward, the temporary holding of light-emitting module 20 is released as illustrated in (c) in FIG. 6. In other words, light-emitting module 20 separates from claw portions 320 and is released.

Accordingly, light-emitting module 20 falls off from holder 30 to achieve surface-contact with placement face 11 of base portion 10. In this embodiment, the entire surface of back face 22*b* of board 22 of light-emitting module 20 is in surface-to-surface contact with placement face 11 of base portion 10. With this, light-emitting module 20 is placed on placement face 11 of base portion 10.

Furthermore, by pressing holder 30 further toward base portion 10 to cause claw portions 320 to further deform and spread outward, the base portion 10-side face (back face of the body portion) of holder 30 achieves surface-to-surface contact with base portion 10 as illustrated in (d) in FIG. 6. With this, holder 30 is placed on placement face 11 of base portion 10.

At this time, since cut-out portions 317 and storage portions 315 are provided in holder 30, claw portions 320 that have deformed and spread outward are stored in storage portions 315 via cut-out portions 317. For example, claw portions 320 are bent at a right angle and stored in storage portions 315.

Accordingly, even if claw portions 320 project from the base portion 10-side face (back face of the body portion) of holder 30, the base portion 10-side face (back face of the body portion) of holder 30 can be easily brought into surface-to-surface contact with base portion 10, and claw portions 320, which have been rendered unnecessary after light-emitting module 20 is released, can be stored and hidden.

It should be noted that although claw portions 320 remain connected to housing 311. (body portion 310) without breaking off in this embodiment, it is acceptable to have claw portions 320 break off and separate from body portion 310 during deforming. In this case, claw portions 320 which have separated are no longer needed, and should be removed.

Furthermore, in the period from when claw portions 320 abut base portion 10 to when holder 30 achieves surface-to-surface contact with base portion 10, holder 30 is placed on base portion 10 in such a way that opening portion 316 surrounds light-emitting module 20 which has separated from clawing portions 320 and was placed on base portion 10 earlier.

In addition, although not illustrated in the figure, in the state illustrated in (d) in FIG. 6, metal electrodes 23 of light-emitting module 20 are in contact with contact terminals, 330 of holder 30. Accordingly, light-emitting module 20 can be placed on base portion 10, with light-emitting module 20 and holder 30 in an electrically connected state.

Furthermore, although the elastic force of the springs of contact terminals 330 having a leaf spring structure causes holder 30 to receive a push-back force (contact pressure at the leaf spring contact point) from light-emitting module 20 which has been placed on base portion 10, pressing holder 30 hard toward base portion 10 allows holder 30 to achieve surface-to-surface contact with base portion 10.

Screwing holder 30 to base portion 10 using screws 40 (FIG. 1) in the above-described state allows holder 30 to be fixed to base portion 10.

Furthermore, by fixing holder 30 to base portion 10, first hole end 314*a* of cylindrical portion 314 of holder 30 can be pressed against front face 22*a* of board 22 of light-emitting module 20. With this, the pressing force of first opening end 314*a* of holder 30 causes light-emitting module 20 to be fixed (properly fixed) to base portion 10.

In this manner, holder 30 according to this embodiment has not only a function for temporarily holding light-emitting module 20 when light-emitting module 20 is to be placed on base portion 20, but also a function for fixing light-emitting module 20 to base portion 10.

Figure 11:
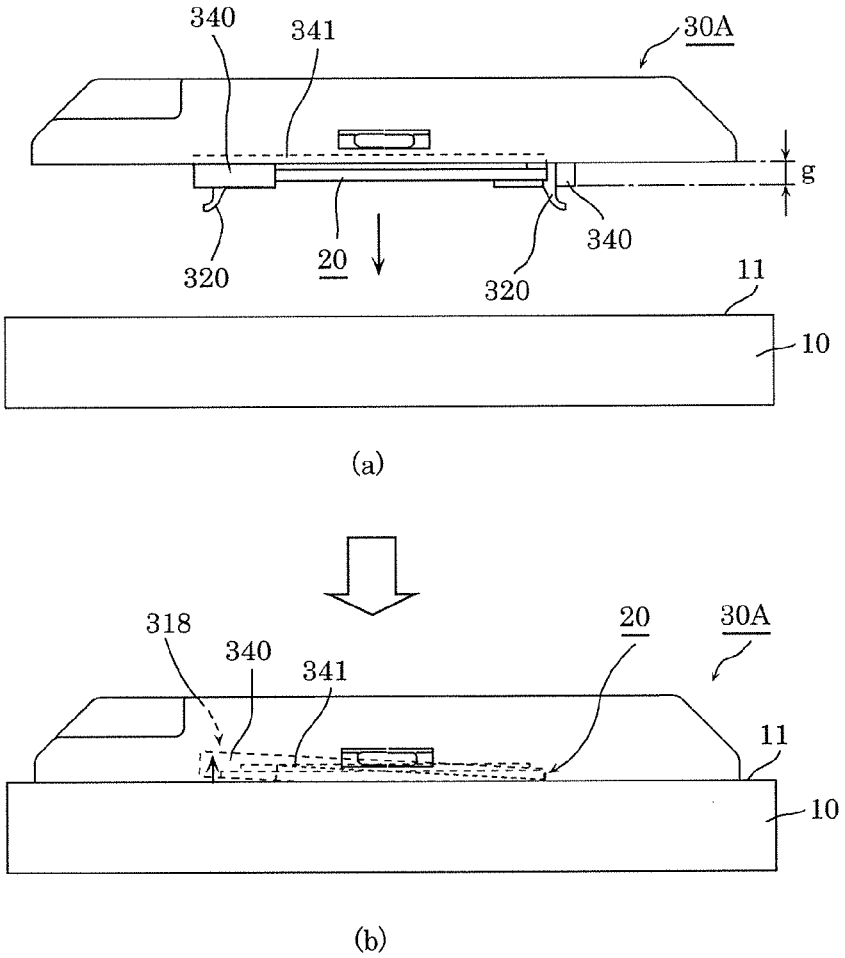
FIG. 11 is a diagram for describing a method of placing the light-emitting module on a base portion, using the holder according to Embodiment 2.

It should be noted that the method of placing light-emitting module 20 illustrated in FIG. 11 can be used as one step in a method of manufacturing a lighting apparatus that includes base portion 10, light-emitting module 20, and holder 30.

[Advantageous Effects, etc.]

Next, the operation and effect of holder 30 according to this embodiment, including circumstances leading to an aspect of the present disclosure, will be described.

Known methods of placing a light-emitting module on a base portion such as a heat sink include a method of temporarily fixing the light-emitting module to a holder and then attaching the light-emitting module to the base portion.

Temporary fixing methods include a method of causing a holder to elastically hold a light-emitting module using the friction between the light-emitting module and an elastic component of the holder, and a method of hooking a light-emitting module using a claw portion of a holder. However, each methods has the problems described below.

Although the contact terminal (leaf spring) of the holder is connected to the metal electrode of the light-emitting module by contact pressure, the method of temporary fixing using friction requires frictional force that can stand the contact pressure to the metal electrode acting at the leaf spring contact point of the contact terminal, and thus it is necessary to temporarily fix the light-emitting module to the holder while opposing the elastic force that produces such frictional force. As such, placing the holder on the base portion is difficult.

Furthermore, since an unexpected outside force may cause the light-emitting module to become detached even after temporary fixing, it is difficult to fix the holder to the base in the state where the light-emitting module is temporarily fixed. As such, with the method of temporary fixing using friction, assemblability between the light-emitting module, the holder, and the base portion is also poor.

On the other hand, in the method of temporarily fixing the light-emitting module using a claw portion, the claw portion needs to hook onto the light-emitting module, and thus the claw portion has a shape that projects toward the base portion from the base portion-side face of the light-emitting module.

Although the light-emitting module and the base portion should be in surface-to-surface contact in order to effectively dissipate the heat from the light-emitting module to the base portion, when a claw portion which projects from the light-emitting module toward the base portion is provided in the holder, the base portion needs to have a recess for storing the claw portion. As such, the contact area between the light-emitting module and the base portion is reduced, and thus there is the problem that heat dissipation deteriorates.

Furthermore, when a recess is not provided in the base portion, the light-emitting module remains hooked onto the claw portion even after the holder is placed on the base portion, and thus the light-emitting module and the holder are fixed to the base portion in a state where the tip of the claw portion abuts the base portion. In this case, the bottom face of the light-emitting module is not entirely in surface-to-surface contact with the base portion, and thus heat dissipation deteriorates.

In this manner, with a holder such as that described above, it is difficult to ensure sufficient heat dissipation for the light-emitting module after being fixed to the base portion while maintaining the assemblability between the holder and the light-emitting module and base portion.

As a result of earnest investigation in view of the aforementioned problems, the inventors have conceived a revolutionary holder that does not require the base portion to have recesses for storing claw portions even when claw portion that lock onto the light-emitting module are provided.

Specifically, holder 30 according to this embodiment includes claw portions 320 that lock onto at least a portion of the base portion 10-side face of light-emitting module 20 to temporarily hold light-emitting module 20. Furthermore, in the state prior to when holder 30 is placed on base portion 10, at least a portion of claw portions 320 are located closer to base portion 10 than the base portion 10-side face of holder 30 is. Furthermore, claw portions 320 are shaped in such a way that, when holder 30 is placed on base portion 10 in the state where light-emitting module 20 is temporarily held, the temporary holding of light-emitting module 20 is released when claw portions 320 abut against base portion 10.

Accordingly, by pressing holder 30 against base portion 10 in the state where light-emitting module 20 is temporarily held by claw portions 320, the pressing force received by claw portions 320 from base portion 10 causes the temporary holding of light-emitting module 20 to be released. As such, light-emitting module 20 falls off from holder 30 and is placed on base portion 10, and thus the entire surface of light-emitting module 20 can be brought into surface-to-surface contact with placement face 11 of base portion 10.

As described above, holder 30 and lighting apparatus 100 according to this embodiment are capable of ensuring sufficient heat dissipation for light-emitting module 20 after light-emitting module 20 is placed on base portion 10, while maintaining the assemblability between holder 30 and light-emitting module 20 and base portion 10.

Furthermore, in this embodiment, abutting portions 322 of claw portions 320 have outwardly-extending shapes.

Accordingly, the pressing force received by claw portions 320 from base portion 10 when holder 30 is pressed against base portion 10 can easily cause claw portions 320 to deform in an outward direction such that light-emitting module 20 separates from claw portions 320. Therefore, light-emitting module 20 can be easily separated from holder 30.

In addition, in this embodiment, abutting faces 322*a* of abutting portions 322 of claw portions 320 are sloped faces or curved faces.

Accordingly, since abutting portion 322 of claw portions 320 can be moved outward along placement face 11 of base portion 10, claw portions 320 can be deformed to spread outward easily.

Furthermore, in this embodiment, storage portions 315 for storing claw portions that have deformed are provided in body portion 310.

Accordingly, since claw portions 320 can be stored in storage portions 315 when claw portions 320 have deformed and collapsed, it is possible to prevent the deformed claw portions 320 from hindering holder 30 and light-emitting module 20 from achieving surface-to-surface contact with placement face 11 of base portion 10.

Embodiment 2

Figure 7A:
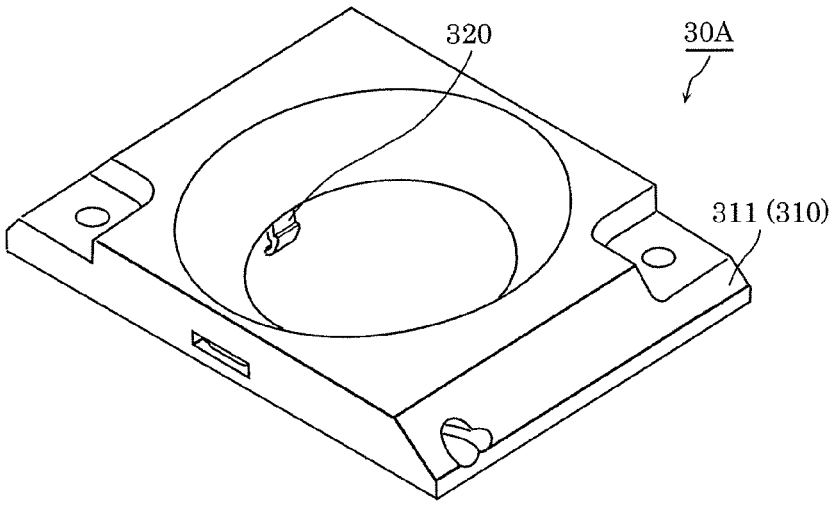
FIG. 7A is a perspective view of a holder according to Embodiment 2 as seen from above.
Figure 7B:
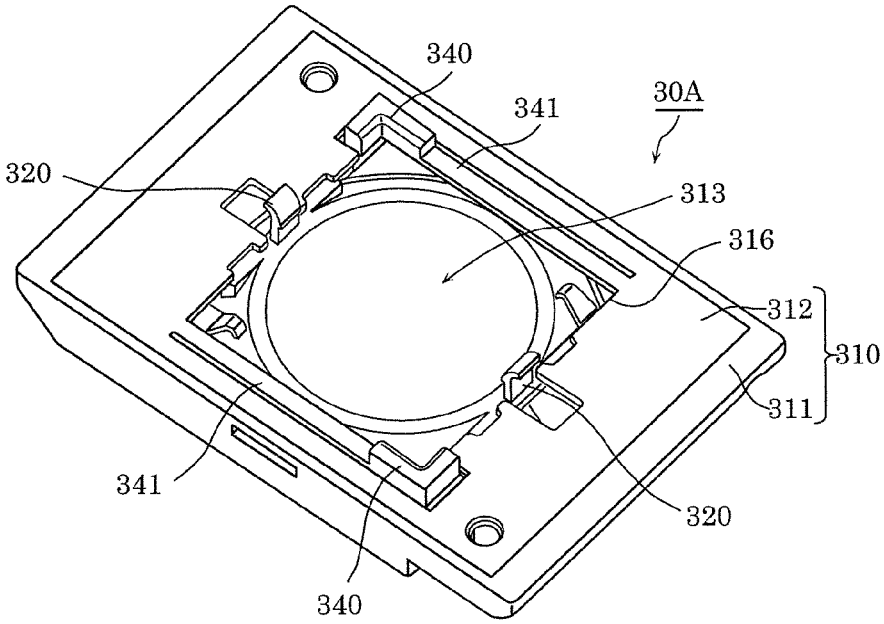
FIG. 7B is a perspective view of the holder according to Embodiment 2 as seen from below.
Figure 8A:
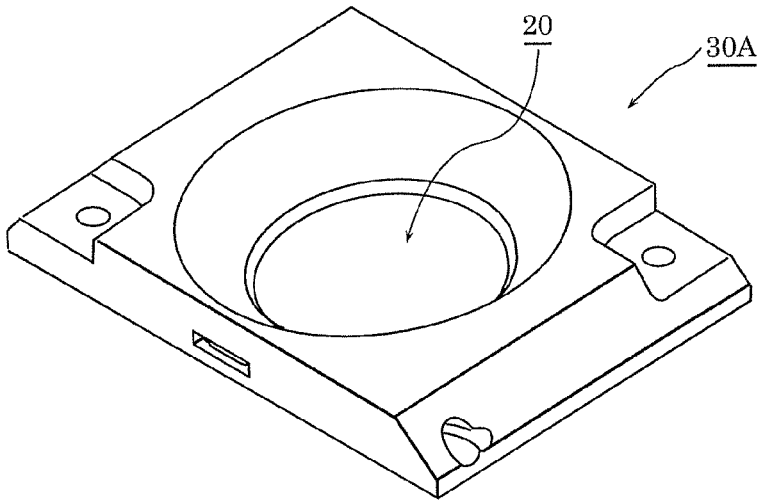
FIG. 8A is a perspective view of a light-emitting module temporarily held by the holder according to Embodiment 2 as seen from above.
Figure 8B:
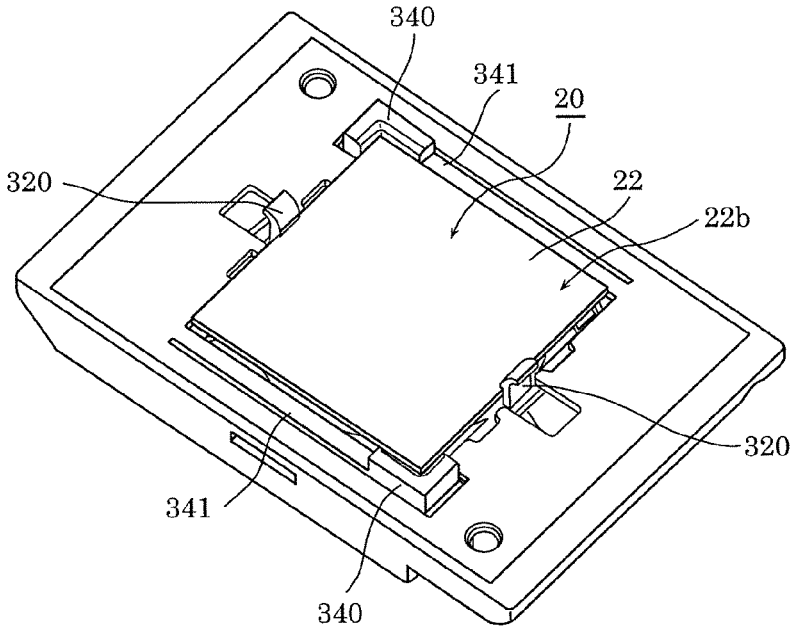
FIG. 8B is a perspective view of the light-emitting module temporarily held by the holder according to Embodiment 2 as seen from below.
Figure 9:
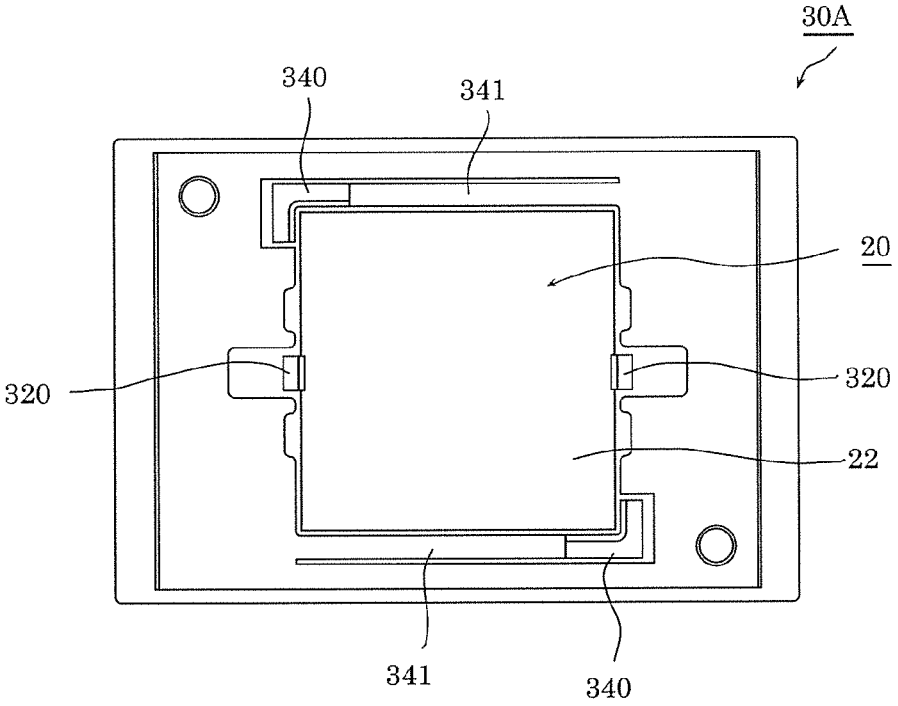
FIG. 9 is a back view of the holder according to Embodiment 2 and the light-emitting module temporarily held by the holder.
Figure 10:
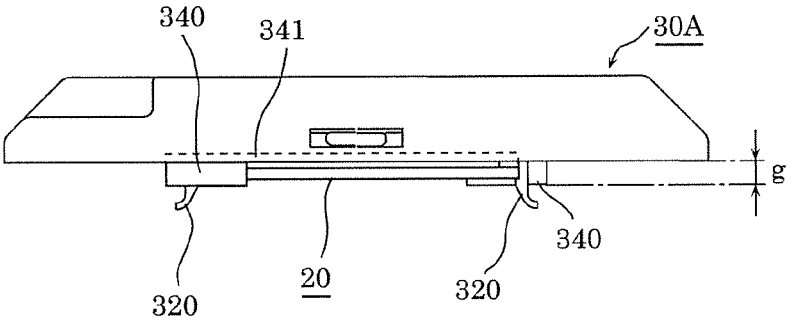
FIG. 10 is side view of the holder according to Embodiment 2 and the light-emitting module temporarily held by the holder.

Next, holder 30A and a lighting apparatus including the same according to Embodiment 2 of the present disclosure will be described using FIG. 7A to FIG. 10. FIG. 7A and FIG. 7B are perspective views of a holder according to Embodiment 2; FIG. 7A is a perspective view from above and FIG. 7B is a perspective view from below. FIG. 8A to FIG. 10 are diagrams illustrating the state in where a light-emitting module is temporarily held by the holder according to Embodiment 2; FIG. 8A is a perspective view from above, FIG. 8B is a perspective view from below, FIG. 9 is a back view, and FIG. 10 is a side view.

As illustrated in FIG. 7A to FIG. 10, compared to holder 30 in Embodiment 1, holder 30A according to this embodiment further includes position restricting portions 340 that restrict the position of light-emitting module 20.

Position restricting portions 340 restrict the horizontal movement of light-emitting module 20 to position light-emitting module 20 at a predetermined area of base portion 10 when light-emitting module 20 is placed on placement face 11 of base portion 10. Specifically, when the direction perpendicular to placement face 11 of base portion 10 is assumed to be the z-axis, position restricting portions 340 restrict the movement of light-emitting module 20 in the directions of the x-axis and y-axis which are orthogonal to the z-axis and orthogonal to each other.

Position restricting portions 340 are provided in body portion 310, and, in this embodiment, are provided at two locations in cover 312.

As illustrated in FIG. 7B, FIG. 8B, and FIG. 9, each of position restricting portions 340 is provided at the tip of a corresponding one of extension portions 341 that extend from opposing opening edge portions of rectangular opening portion 316 of cover 312. Each of extension portions 341 is a portion of cover 312, and is formed in the shape of narrow elongated boards. Specifically, each of extension portions 341 is an arm portion having a tip, which is a free end, on which a corresponding one of position restricting portions 340 is provided.

As illustrated in FIG. 8B and FIG. 9B, position restricting portions 340 according to this embodiment are shaped like the letter L in the plan view to correspond to corners of rectangular board 22 of light-emitting module 20. Specifically, each of position restricting portions 340 includes a portion that faces a part of one side of two adjacent sides of board 22 and a portion that faces a part of the other side. Furthermore, a small space is present between each of position restricting portions 340 and board 22.

As illustrated in FIG. 10, in the state prior to when holder 30A is placed on base portion 10, at least a portion of each of position restricting portions 340 is located closer to base portion 10 than the base portion 10-side face of holder 30A (i.e., the back face of cover 312) is. In other words, position restricting portions 340 are projections that project further than the base portion 10-side face of holder 30A.

Next, the method used when placing light-emitting module 20 on base portion 10 using holder 30A will be described using FIG. 11. FIG. 11 is a diagram for describing the method of placing the light-emitting module on the base portion, using the holder according to Embodiment 2.

As illustrated in (a) in FIG. 11, as in Embodiment 1, hooking light-emitting module 20 onto hook portions 321 of the pair of claw portions 320 of holder 30A allows light-emitting module 20 to be temporarily held by (temporarily fix to) holder 30A, and thus allowing holder 30A and light-emitting module 20 to be integrated.

Then, in such a state, holder 30A is lowered onto placement face 11 of base portion 10, and holder 30A is pressed in the attachment direction toward base portion 10, to cause claw portions 320 to deform and release the temporary holding of light-emitting module 20, as in Embodiment 1. Accordingly, as illustrated in (b) in FIG. 11, light-emitting module 20 can be placed, with surface-to-surface contact, on placement face 11 of base portion 10.

At this time, since position restricting portions 340 are provided in holder 30A in this embodiment, horizontal movement of light-emitting module 20 is restricted by position restricting portions 340 even after light-emitting module 20 is placed on base portion 10.

Furthermore, in this embodiment, abutting of position restricting portions 340 against base portion 10 when holder 30A is placed on base portion 10 causes position restricting portions 340 to be stored inside body portion 310.

Specifically, as illustrated in (b) in FIG. 11, the abutting of position restricting portions 340 against base portion 10 causes elongated extension portions 341 on which tips position restricting portions 340 are connected, to deform starting from the root portion, and thus position restricting portions 340 move up in a direction away from base portion 10. Furthermore, position restricting portions 340 which have moved up are stored in storage portions 318 provided in body portion 310.

Accordingly, it is possible to prevent position restricting portions 340 from hindering holder 30A and light-emitting module 20 from achieving surface-to-surface contact with placement face 11 of base portion 10.

It should be noted that storage portions 318 are spatial regions located at least in a movable region of respective position restricting portions 340, and are spatial regions that are clear of any obstacles to position restricting portions 340.

Furthermore, as illustrated in FIG. 10 and (a) in FIG. 11, in this embodiment, gap g between the base portion 10-side face of holder 30A (body portion 310) and the base portion 10-side faces of position restricting portions 340 at the position at which the temporary holding of light-emitting module 20 by claw portions 320 is released (position at which light-emitting module 20 separates from claw portions 320) should be set to allow the space between position restricting portions 340 and base portion 10 to be less than the thickness of light-emitting module 20.

Accordingly, the position of light-emitting module 20 can be finely corrected even after the temporary holding by claw portions 320 is released, and thus assembly workability can be improved.

In other words, although movement of light-emitting module 20 in the x-axis, y-axis, and z-axis directions is restricted in the state in which light-emitting module 20 is temporarily held by claw portions 320, such restriction is also released when claw portions 320 deform and the temporary holding is released. In this case, without position restricting portions 340, the relative positional relationship between light-emitting module 20 and holder 30A would change if holder 30A shifts in the x-axis or y-axis direction in the period from when the restriction by claw portions 320 is released to when holder 30A is properly placed on and fixed to base portion 10. At this time, in order to constantly maintain the restriction in the x-axis and y-axis directions in the period from when the temporary holding by claw portions 320 is released to when holder 30A is properly fixed, in the task of attaching holder 30A and base portion 10, the height (gap g) of position restricting portions 340 in the z-axis direction in which the restriction by claw portions 320 is released should be set to a dimension that does not allow movement of light-emitting module 20 in the x-axis and y-axis directions. At this time, movement of light-emitting module 20 is prevented by eliminating any gap greater than or equal to the thickness of light-emitting module 20 in the x-axis and y-axis directions of light-emitting module 20. Therefore, by setting gap g to allow the space between position restricting portions 340 and base portion 10 to be less than the thickness of light-emitting module 20, at the position of holder 30A relative to base portion 10, in the z-axis direction at which the temporary holding by claw portions 320 is released during the attaching operation, the position of light-emitting module 20 in the x-axis and y-axis directions can be restricted at all times in the period from the temporary holding up to the proper fixing of light-emitting module 20.

As described above, holder 30A and the lighting apparatus according to this embodiment have the same configuration as in Embodiment 1, and thus the same operation and effect as in Embodiment 1 can be obtained.

In addition, holder 30A and the lighting apparatus according to this embodiment further include position restricting portions 340 which restrict the position of light-emitting module 20.

Accordingly, since the position of light-emitting module 20 can be restricted by position restricting portions 340, it is possible to keep light-emitting module 20 at a predetermined position on base portion 12 even after light-emitting module 20 has separated from holder 30A and is placed on base portion 10.

Embodiment 3

Figure 12A:
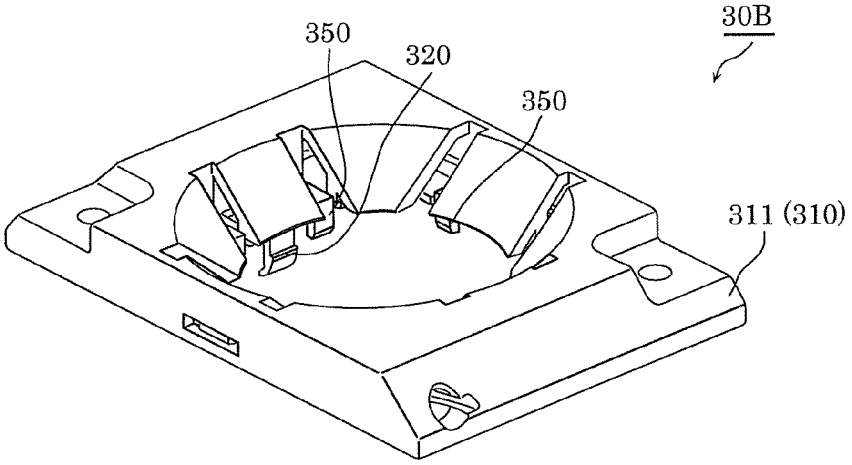
FIG. 12A is a perspective view of a holder according to Embodiment 3 as seen from above.
Figure 12B:
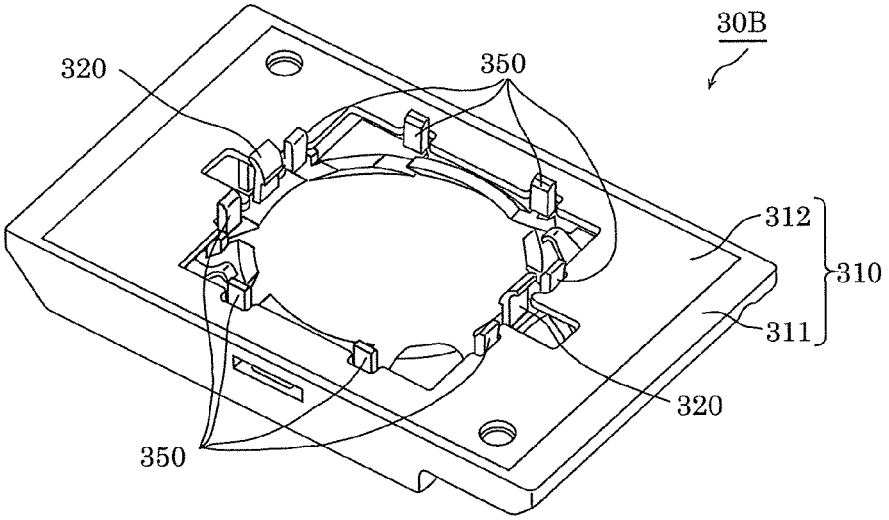
FIG. 12B is a perspective view of the holder according to Embodiment 3 as seen from below.
Figure 13A:
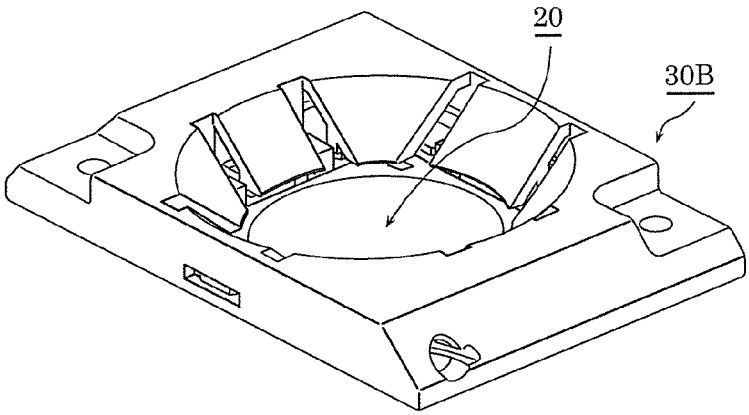
FIG. 13A is a perspective view of a light-emitting module temporarily held by the holder according to Embodiment 3 as seen from above.
Figure 13B:
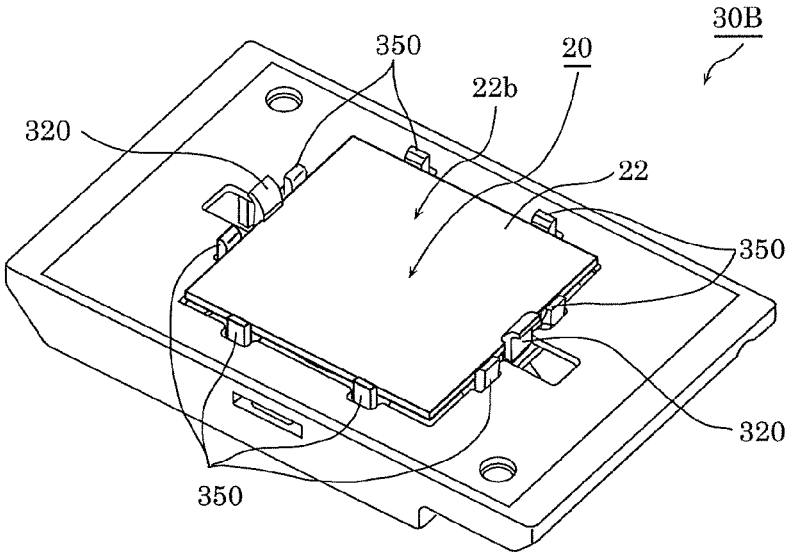
FIG. 13B is a perspective view of the light-emitting module temporarily held by the holder according to Embodiment 3 as seen from below.
Figure 14:
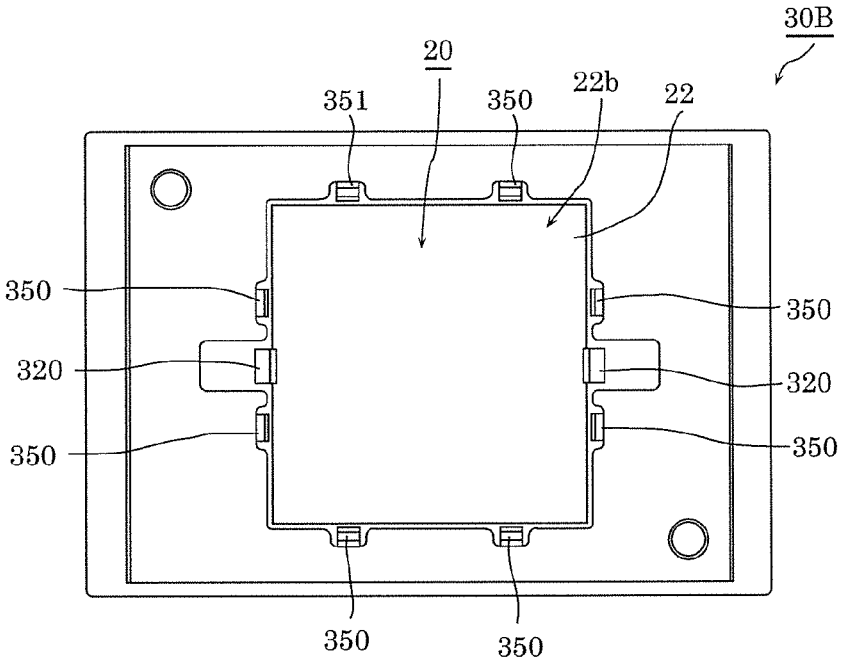
FIG. 14 is back view of the holder according to Embodiment 3 and the light-emitting module temporarily held by the holder.
Figure 15:
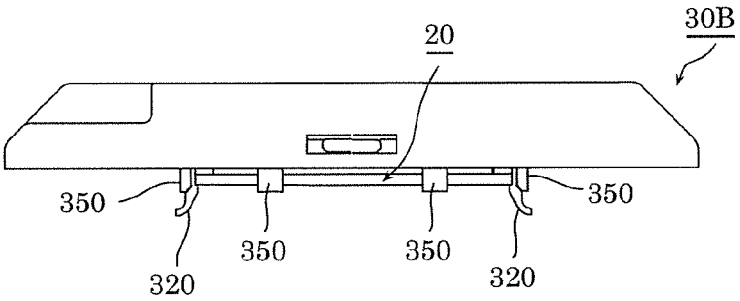
FIG. 15 is side view of the holder according to Embodiment 3 and the light-emitting module temporarily held by the holder.
Figure 16:
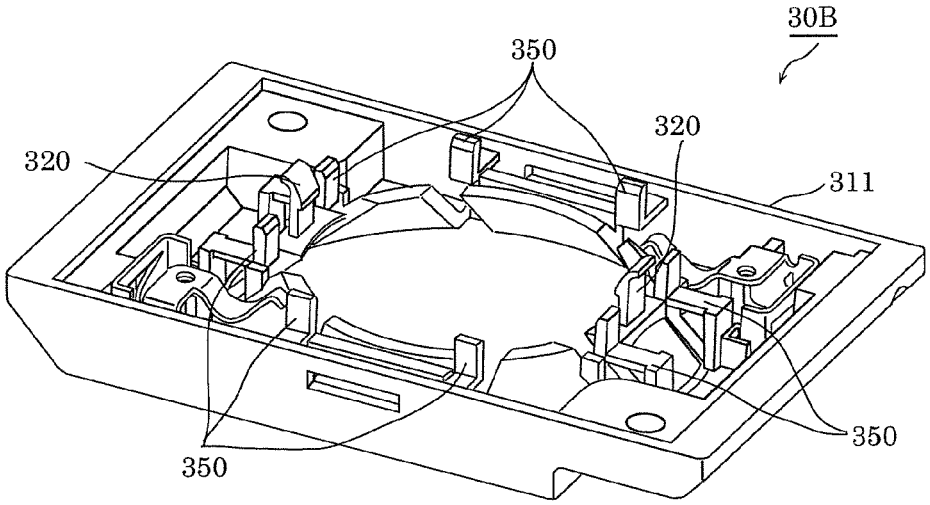
FIG. 16 is a perspective view of a housing of the holder according to Embodiment 3 as seen from below.

Next, holder 30B and a lighting apparatus including the same according to Embodiment 3 of the present disclosure will be described using FIG. 12A to FIG. 16. FIG. 12A and FIG. 12B are perspective views of a holder according to Embodiment 3; FIG. 12A is a perspective view from above and FIG. 12B is a perspective view from below. FIG. 13A to FIG. 15 are diagrams illustrating the state in which the light-emitting module is temporarily held by the holder according to Embodiment 3; FIG. 13A is a perspective view from above, FIG. 13B is a perspective view from below, FIG. 14 is a back view, and FIG. 15 is a side view. FIG. 16 is a perspective view of a housing of the holder according to Embodiment 3 as seen from below.

As illustrated in FIG. 12A to FIG. 16, compared to holder 30 in Embodiment 1, holder 30B according this embodiment further includes position restricting portions 350 that restrict the position of light-emitting module 20.

Position restricting portions 350 restrict the horizontal movement of light-emitting module 20 to position light-emitting module 20 at a predetermined area of base portion 10 when light-emitting module 20 is placed on placement face 11 of base portion 10. Position restricting portions 350 are provided in body portion 310, and, in this embodiment, are provided at eight locations in housing 311.

Position restricting portions 350 according to this embodiment are formed to correspond to the four sides of rectangular base 22 of light-emitting module 20. Specifically, position restricting portions 350 are formed to face each of the four faces of board 22. Accordingly, position restricting portions 350 restrict the movement in horizontal directions (i.e., the directions of the two horizontally orthogonal axes) of the plane defined by the two axis directions of two adjacent sides of board 22 of light-emitting module 20 in the horizontal directions. Furthermore, a small space is present between position restricting portion 350 and board 22.

As illustrated in FIG. 16, in the state prior to when holder 30B is placed on base portion 10, at least a portion of each of position restricting portions 350 is located closer to base portion 10 than the base portion 10-side face of holder 30B (i.e., the back face of cover 312) is. In other words, position restricting portions 350 are projections that project further than the base portion 10-side face of holder 30B.

Figure 17:
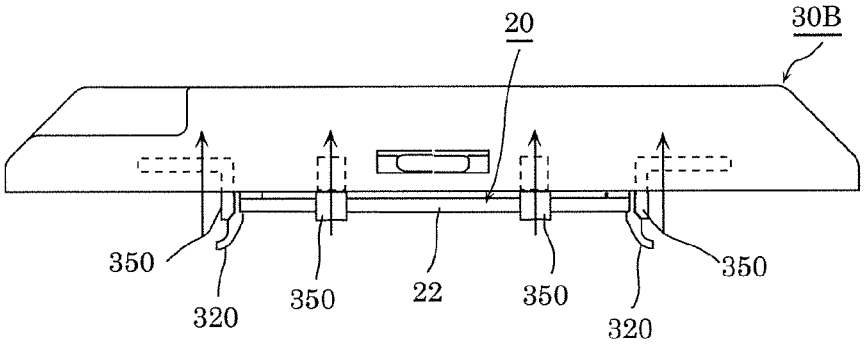
FIG. 17 is a diagram for describing a method of placing the light-emitting module on a base portion, using the holder according to Embodiment 3.

Next, the method used when placing light-emitting module 20 on base portion 10 using holder 30B will be described using FIG. 17. FIG. 17 is a diagram for describing the method of placing the light-emitting module on the base portion, using the holder according to Embodiment 3.

As in Embodiment 1, in this embodiment, light-emitting module 20 is temporarily held by (temporarily fixed to) the pair of claw portions 320 of holder 30B to integrate holder 30B and light-emitting module 20, and holder 30B is pressed toward base portion 10 in this state. This causes claw portions 320 to deform and release the temporary holding of light-emitting module 20 to place light-emitting module 20 on placement face 11 of base portion 10.

At this time, since position restricting portions 350 are provided in holder 30B in this embodiment, horizontal movement of light-emitting module 20 is restricted by position restricting portions 350 even after light-emitting module 20 is placed on base portion 10, as illustrated in FIG. 17.

Furthermore, in this embodiment, position restricting portions 350 in such a way that abutting of position restricting portions 350 against base portion 10 when holder 30B is placed on base portion 10 causes position restricting portions 350 to be stored inside body portion 310.

Specifically, as illustrated in FIG. 17, the abutting of the tips of position restricting portions 350 against base portion 10 causes position restricting portions 350 to elastically deform and move up in a direction away from base portion 10. Furthermore, position restricting portions 350 which have moved up are stored in body portion 310.

Accordingly, it is possible to prevent position restricting portions 350 from hindering holder 30B and light-emitting module 20 from achieving surface-to-surface contact with placement face 11 of base portion 10.

Furthermore, in this embodiment too, the gap between the base portion 10-side face of holder 30B (body portion 310) and the base portion 10-side face of position restricting portions 350 at the position where the temporary holding of light-emitting module 20 by claw portions 320 is released (i.e., position at which light-emitting module 20 separates from claw portions 320) should be set to allow the space between position restricting portions 350 and base portion 10 to be less than the thickness of light-emitting module 20.

Accordingly, the position of light-emitting module 20 can be finely corrected even after the temporary holding by claw portions 320 is released, and thus assembly workability can be improved.

As described above, holder 30B and the lighting apparatus according to this embodiment have the same configuration as in Embodiment 1, and thus the same operation and effect as in Embodiment 1 can be obtained.

In addition, holder 30B and the lighting apparatus according to this embodiment further include position restricting portions 350 which restrict the position of light-emitting module 20.

Accordingly, since the position of light-emitting module 20 can be restricted by position restricting portions 350, it is possible to keep light-emitting module 20 at a predetermined position on base portion 10 even after light-emitting module 20 has separated from holder 30B and is placed on base portion 10.

Embodiment 4

Figure 18:
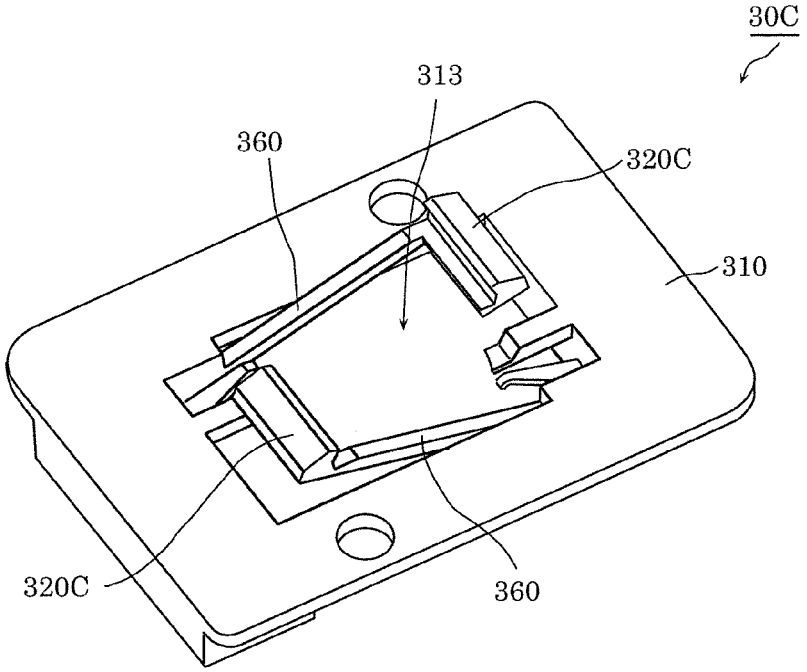
FIG. 18 is a perspective view of a holder according to Embodiment 4 as seen from below.
Figure 19:
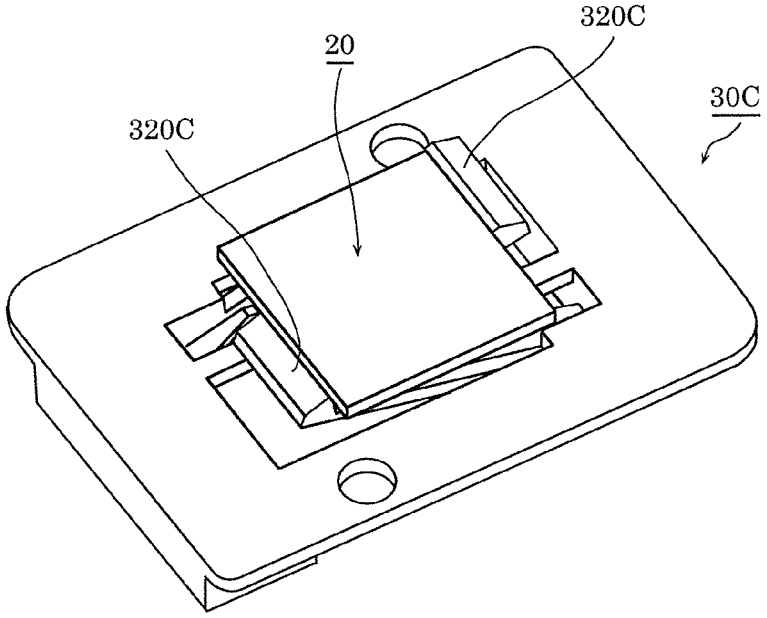
FIG. 19 is a perspective view of the holder according to Embodiment 4 as seen from below.
Figure 20:
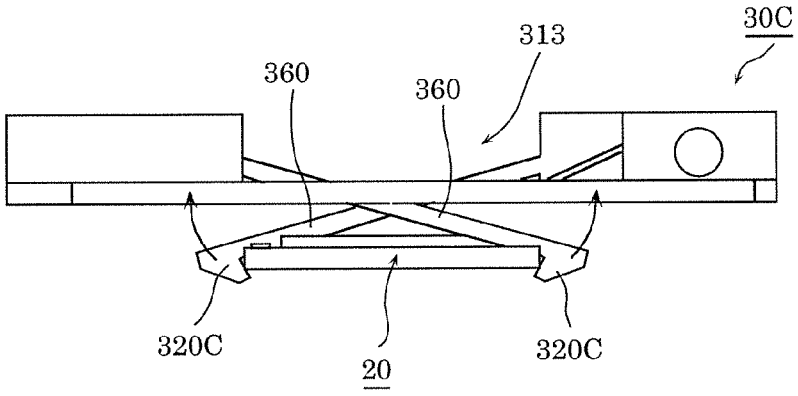
FIG. 20 is a side view of the holder according to Embodiment 4.

Next, holder 30C and a lighting apparatus including the same according to Embodiment 4 of the present disclosure will be described using FIG. 18 to FIG. 20. FIG. 18 is a perspective view of a holder according to Embodiment 4 as seen from below; FIG. 19 and FIG. 20 are diagrams illustrating the state in which the light-emitting module is temporarily held by the holder according to Embodiment 4. FIG. 19 is a perspective view from below, and FIG. 20 is a side view.

As illustrated in FIG. 18 to FIG. 20, holder 30C according to this embodiment includes body portion 310, claw portions 320C provided in body portion 310, and a pair of contact terminals (not illustrated).

As in Embodiment 1, body portion 310 includes opening portion 313 which is provided as an opening for light-emitting component 21 of light-emitting module 20.

As in Embodiment 1, claw portions 320C have a structure that locks onto at least a portion of the base portion 10-side face of light-emitting module 20 to temporarily hold light-emitting module 20 when light-emitting module 20 is to be placed on base portion 10. For example, claw portions 320C lock onto at least a portion of back face 22*b* of board 22 of light-emitting module 20 to temporarily hold (temporarily fix) light-emitting module 20.

Each of claw portions 320C according to this embodiment has arm portion 360 which is provided spanning opening portion 313. Arm portions 360 according to this embodiment are provided as a pair spanning opening portion 316 and crossing with each other in a side view. A hook portion for locking onto and temporarily holding light-emitting module 20 is provided at the tip of each of arm portions 360.

Next, the method used when placing light-emitting module 20 on base portion 10 using holder 30C will be described using FIG. 20.

As in Embodiment 1, in this embodiment, light-emitting module 20 is temporarily held by (temporarily fixed to) the pair of claw portions 320C of holder 30C to integrate holder 30C and light-emitting module 20, and holder 30C is pressed toward base portion 10 in this state. This causes claw portions 320C to deform and release the temporary holding of light-emitting module 20 to place light-emitting module 20 on placement face 11 of base portion 10.

At this time, since claw portions 320C include arm portions 360 provided spanning opening portion 313 in this embodiment, as illustrated in FIG. 20, the time from when clawing portions 320C abut base portion 10 to when clawing portions 320C release light-emitting module 20 can be lengthened compared to Embodiment 1.

In other words, in Embodiment 1, clawing portions 320 project substantially perpendicular to placement face 11 of base portion 10, and thus the turning angle when clawing portions 320 deform becomes big. As such, light-emitting module 20 separates from claw portions 320 immediately after claw portions 320 abut base portion 10.

In contrast, in this embodiment, claw portions 320C include arm portions 360 provided spanning opening portion 313, and thus the turning angle when claw portions 320C deform becomes small. Accordingly, light-emitting module 20 is still held by claw portions 320C for a short period even after claw portions 320C abut base portion 10.

Therefore, compared to Embodiment 1, in embodiment, light-emitting module 20 can be placed accurately at the predetermined position in base portion 10. Furthermore, in this embodiment, when holder 30C temporarily holds light-emitting module 20 at a position away from placement face 11 of base portion 10, and holder 30C holding light-emitting module 20 is to be placed on base portion 10, it becomes easy for claw portions 320C to follow light-emitting module 20, and thus assemblability can be improved.

As described above, holder 30C and the lighting apparatus according to this embodiment include clawing portion 320C in the same manner as in Embodiment 1.

Accordingly, it is possible to ensure sufficient heat dissipation for light-emitting module 20 after light-emitting module 20 is placed on base portion 10, while maintaining the assemblability between holder 30C and light-emitting module 20 and base portion 10.

In addition, in this embodiment, claw portions 320C have arm portions 360 which are provided spanning opening portion 313.

Accordingly, positioning accuracy and assemblability of light-emitting module 20 is improved compared to Embodiment 1.

(Variations)

Although the holder and the lighting apparatus according to this embodiment are described based on exemplary embodiments thus far, the present disclosure is not limited to these embodiments.

For example, light-emitting module 20 is exemplified as an LED module having a COB structure, light-emitting module 20 may be an LED module having a surface mount device (SMD) structure. An LED module having an SMD structure is configured by mounting one or more SMD type LED elements in which at least one LED chip (bare chip) is mounted inside a resin container and sealed using a sealing component.

Furthermore, in the foregoing embodiment, the light-emitting element used as a light source by light-emitting module 20 is not limited to an LED, and some other solid-state light-emitting element such as a semiconductor light-emitting element, such as a semiconductor laser, or an organic electro-luminescent (EL) or a non-organic EL element may be used.

Aside from the above, forms obtained by various modifications to the respective exemplary embodiments that can be conceived by a person of skill in the art as well as forms realized by arbitrarily combining structural components and functions in the respective exemplary embodiments which are within the scope of the essence of the present disclosure are included in the present disclosure.

What is claimed is:

1. A holder to hold a light-emitting module, the holder comprising:

a body having an opening that exposes a light-emitting source of the light-emitting module;

a notch provided at a periphery of the opening; and a claw that passes through the notch at the periphery of the opening to protrude from the body, the claw being configured to hold the light-emitting module, wherein the body comprises a housing and a cover attached to the housing, the notch is provided in the cover, the claw is provided on the housing and passes through the notch to protrude from the cover, and a hollow space is provided between the housing and the cover, at a position corresponding to the notch, the hollow space being configured to receive the claw, wherein the hollow space is configured to receive the claw through the notch when the claw is bent.

2. The holder according to claim 1, wherein a tip portion of the claw extends in a direction away from the opening and transverse to a protruding direction of the claw.

3. The holder according to claim 2, wherein the claw comprises a pair of claws provided with portions facing each other across the light-emitting module, and a distance between tip portions of the pair of claws increases toward distal ends of the tips.

4. The holder according to claim 2, wherein an inner surface of the tip portion facing the opening is either one of a sloped face and a curved face.

5. The holder according to claim 1, wherein the body further includes a position restrictor that restricts a position of the light-emitting module with respect to the holder.

6. The holder according to claim 1, the claw includes an arm spanning the opening, and the arm includes, at a tip, a hook that locks onto the light-emitting module.

7. The holder according to claim 1, wherein a length of the notch in a direction away from the opening is longer than a length of the claw protruding from the body.

8. A holder to be placed on a base together with a light-emitting module, the light-emitting module having a board-like shape, the holder comprising:

a body; and a claw that is provided in the body, and locks onto at least a portion of a base side face of the light-emitting module to temporarily hold the light-emitting module when the light-emitting module is to be placed on the base, wherein, before the holder is placed on the base, at least a portion of the claw is located closer to the base than a base side face of the holder is, the claw is configured to release the temporary holding of the light-emitting module as a result of the claw abutting the base when the holder is placed on the base with the light-emitting module being temporarily held by the claw, the body has an opening for a light-emitting component of the light-emitting module, the claw includes an arm spanning the opening, the arm includes, at a tip, a hook that locks onto the light-emitting module, and the arm comprises a pair of arms spanning the opening and crossing with each other.

9. A lighting apparatus comprising:

a base;

a light-emitting module provided on a placement face of the base; and a holder attached to the base, wherein the holder comprises:

a body;

a claw that is provided on the body of the holder, and is bent to extend along the placement face of the base;

an opening through which light from the light-emitting module is emitted;

a notch provided at a periphery of the opening, the claw passing through the notch to protrude from the holder; and a hollow space provided in the holder and connecting to the notch, wherein at least a portion of the bent claw is received in the hollow space through the notch.

10. The lighting apparatus according to claim 9, wherein the claw remains connected to the body without breaking off.

11. The lighting apparatus according to claim 9, wherein the claw of the holder extends in a direction transverse to the placement face of the base before the holder is attached to the base, and is configured to deform to extend along the placement face of the base, when the holder is attached to the base.

12. The lighting apparatus according to claim 9, wherein the claw is bent in a direction away from the light-emitting module.

13. A method of manufacturing a lighting apparatus including a base having a placement face, a light-emitting module, and a holder, the method comprising:

temporarily holding the light-emitting module using a claw of the holder;

bringing the claw of the holder into contact with the placement face of the base to release the temporary holding of the light-emitting module by the claw by deforming the claw; and pressing the claw to the placement face of the base to bend the claw until the bent claw extends along the placement face of the base, wherein the holder has an opening through which light from the light-emitting module is emitted; a notch provided at a periphery of the opening, the claw passing through the notch to protrude from the holder; and a hollow space provided in the holder and connecting to the notch, wherein the method further comprising:

storing at least a portion of the bent claw in the hollow space through the notch.

14. The method according to claim 13, further comprising:

screwing the holder to the base such that the light-emitting module is provided between the holder and the base.

* * * * *